United States Patent [19]

Kuo

[11] Patent Number: 4,475,527

[45] Date of Patent: Oct. 9, 1984

[54] INGOT SLICING MACHINE AND METHOD

[75] Inventor: Yu Shen Kuo, La Crescenta, Calif.

[73] Assignee: The United States of America as represented by the Administrator of the National Aeronautics and Space Administration, Washington, D.C.

[21] Appl. No.: 387,648

[22] Filed: Jun. 11, 1982

[51] Int. Cl.³ ..... B28D 1/04

[52] U.S. Cl. ..... 125/13 R; 82/90; 83/664; 83/676; 125/15; 51/73 R

[58] Field of Search ..... 83/676, 664; 51/73 R, 51/105 VG; 125/15, 13 R; 82/46 R, 47, 70.1, 70.2, 81, 83, 89, 90

[56] References Cited

U.S. PATENT DOCUMENTS

| | | | |
|---|---|---|---|
| 2,356,038 | 8/1944 | Edwards | 82/90 |
| 3,039,235 | 6/1962 | Heinrich | 125/13 R |
| 3,550,323 | 12/1970 | Balsiger | 51/105 VG |
| 4,150,912 | 4/1979 | Gutsche | 51/73 R |

*Primary Examiner*—Harold D. Whitehead
*Attorney, Agent, or Firm*—Paul F. McCaul; John R. Manning; Thomas H. Jones

[57] ABSTRACT

An improvement in a method for simultaneously slicing one or a multiplicity of boules of silicon into silicon wafers, the improvement of which comprises forming a plurality of vertical stacks of horizontal saw blades of circular configuration arranged in juxtaposed coaxial alignment, each blade being characterized by having a cutting diameter slightly greater than the cutting diameter of the blade arranged immediately thereabove; imparting simultaneous rotation to the blades, supporting in depending relation a plurality of enlongated boules of silicon, simultaneously translating the boules through the blades, and simultaneously imparting rotation to the boules as the boules are passed through said blades for slicing wafers therefrom; and an improved apparatus for performing said method.

8 Claims, 11 Drawing Figures

INGOT SLICING MACHINE AND METHOD

ORIGIN OF THE INVENTION

The invention described herein was made in the performance of work under a NASA Contract and is subject to the provisions of Section 305 of the National Aeronautics & Space Act of 1958, Public Law 85-568 (72 STAT 435; 42 U.S.C. 2457.)

BACKGROUND OF THE INVENTION

The invention generally relates to a method and apparatus for simultaneously slicing a plurality of wafers from an ingot or boule, or a plurality of boules, of silicon, or other from hard to slice materials such as garnet, sapphire or the like.

DESCRIPTION OF THE PRIOR ART

Prior art machines for slicing boules into wafers are known in which a boule is suspended at its upper end with its longitudinal axis upright for cutting by an abrasive impregnated, circular blade which rotates about an axis parallel to the longitudinal axis of the boule. In slicing boules into wafers, a so-called inner diameter (I.D.) blade may be used which has an annular ring configuration, and is mounted by suitable means that engage the outer circumference of the blade for driving an abrasive-embedded cutting edge mounted on its inner circumference for slicing the boule. Some prior machines also slice a boule by using a rotary O.D. blade, in which its outer periphery or cutting edge is embedded with abrasives.

U.S. Pat. No. 4,084,354 to Grandia and Hill is generally directed to severing single wafers from a boule, in which I.D. cutting is utilized. According to the patent, a processing step is used which aligns the crystallographic axis of the silicon with the longitudinal axis of the boule so that the sliced wafers have the desired crystallographic orientation.

U.S. Pat. No. 3,288,128 to Fehlmann relates to a holder for a ring-shaped cutting blade of the I.D. type used in "cutting into fine slices hard metals and alloys and other hard materials" such as ruby. The patent allegedly provides means for overcoming deformation of the blade resulting from centrifugal force generated by high-speed rotation.

U.S. Pat. No. 4,150,912 to Gutsche et al., discloses the use of ring-shaped twin cutting blades of the I.D. type somewhat similar to that of Fehlmann. By using hydraulic means for tensioning and retensioning of the twin blades after prolonged use, the blades alledgedly are of the same diameter.

U.S. Pat. No. 3,091,562 to Price discloses the use of a pair of grinding wheels positioned on a single spindle for plunge grinding. One wheel is coarse grained and used for roughing while the other wheel is fine grained and used for finishing. The wheels, although of different diameter, are used only for grinding and not for slicing.

U.S. Pat. No. 2,704,422 to Norton concerns the use of ganged grinding wheels of the same diameter for grinding the lands of a helical strip of piston ring material.

OBJECTS AND SUMMARY OF THE INVENTION

It is an object of the invention to provide an improved method and apparatus for slicing one or more boules into wafers without substantial breakage while increasing the rate of wafer production as compared with prior procedures.

It is another object to provide an apparatus using a stack of spaced cutting blades of circular configuration for slicing boules into wafers.

Another object is to provide means for advancing a plurality of boules through a stack of spaced cutting blades for slicing the boules.

Another object is to provide in an apparatus for slicing boules into wafers through use of a plurality of stacked, circular blades having differing diameters with each blade having an annular cutting edge.

It is another object to provide in an apparatus for slicing boules in which a plurality of stacked blades of differing diameter are used to serially part wafers from the lowermost ends of the boules.

DESCRIPTION OF THE INVENTION

Figure 1:
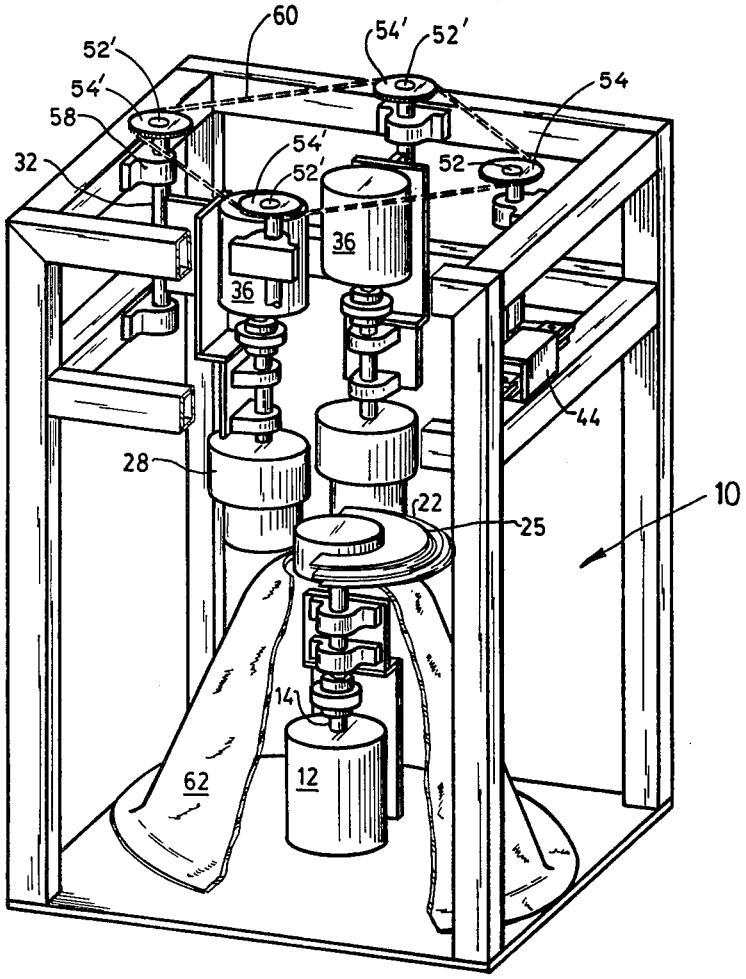
FIG. 1 is a fragmented perspective view of a first embodiment of the invention.

The wider use of photovoltaic devices for producing electrical power from solar insolation is a national goal. However, the cost and difficulty of producing suitable blanks for use in solar cells are limiting factors to the greater utilization of solar cells. Production of solar cells by current technology involves growing cylindrical ingots or boules of single-crystal silicon which are then sliced into thin wafers of up to six inches in diameter. Such wafers are then subsequently processed to become solar cells.

The wafering operation involves the use of circular blades whose rims are impregnated with diamond dust, carborundum or other suitable abrasives for severance of the wafers from the boules. This is a slow machine process which is not only costly but often causes much wafer breakage. The wafer yield is, thus, much lower than is desired, which results in higher wafer cost. Strips and wires may also be used for slicing silicon boules with some advantages, but the predominant slicing methods used by the semiconductor industry involves the circular blade approach.

Other methods of producing solar cell blanks are being intensively explored. Such methods include ribbon and sheet growth, deposition, and so forth. However, until such methods are commercially practicable it will still be necessary to produce wafers by sawing boules. Thus, any approach for improving the yield of wafers produced by sawing is of high commercial interest.

Generally speaking, the present invention employs circular blade assemblies which are made up of a large number of ganged, stacked blades that may engage vertically-rotating boules, to cut wafers therefrom in parallel planes. Preferably, the blades engage a plurality of boules chosen such that cutting stresses on the blades are offset by opposing forces, although certain features of the invention may apply to the slicing of a single boule. Typically, the number of boules engaged is evenly divisible e.g., 2, 4, etc., but other multiples may also be used if the stresses imposed or the blades are opposed. This reduces wafer chippage and breakage and the wafer yield may, therefore, be significantly increased.

In a first embodiment of the invention shown in FIGS. 1 through 5B, the cutting surfaces are on the outer diameters of the cutter blades. A second embodiment shown in FIGS. 6 through 10, may employ cutting blades with cutting surfaces on the inner diameters of the blades. Both embodiments utilize the improvements disclosed herein.

Referring to FIGS. 1–5B, an apparatus 10 may include a motor 12 with an output shaft 14 coupled at 16 to a drive shaft 18 for a blade holder 20. The bladeholder 20 may support a plurality, e.g., as many as 250 or more, of blades 22 positioned in stacked configuration. The blades 22 may be secured to holder 20 by means of pins 24 or any other suitable means of connection. Since the bladeholder 20 is secured to the drive shaft 18, the operation of motor 12 may impart rotation to the blades 22.

Figure 3:
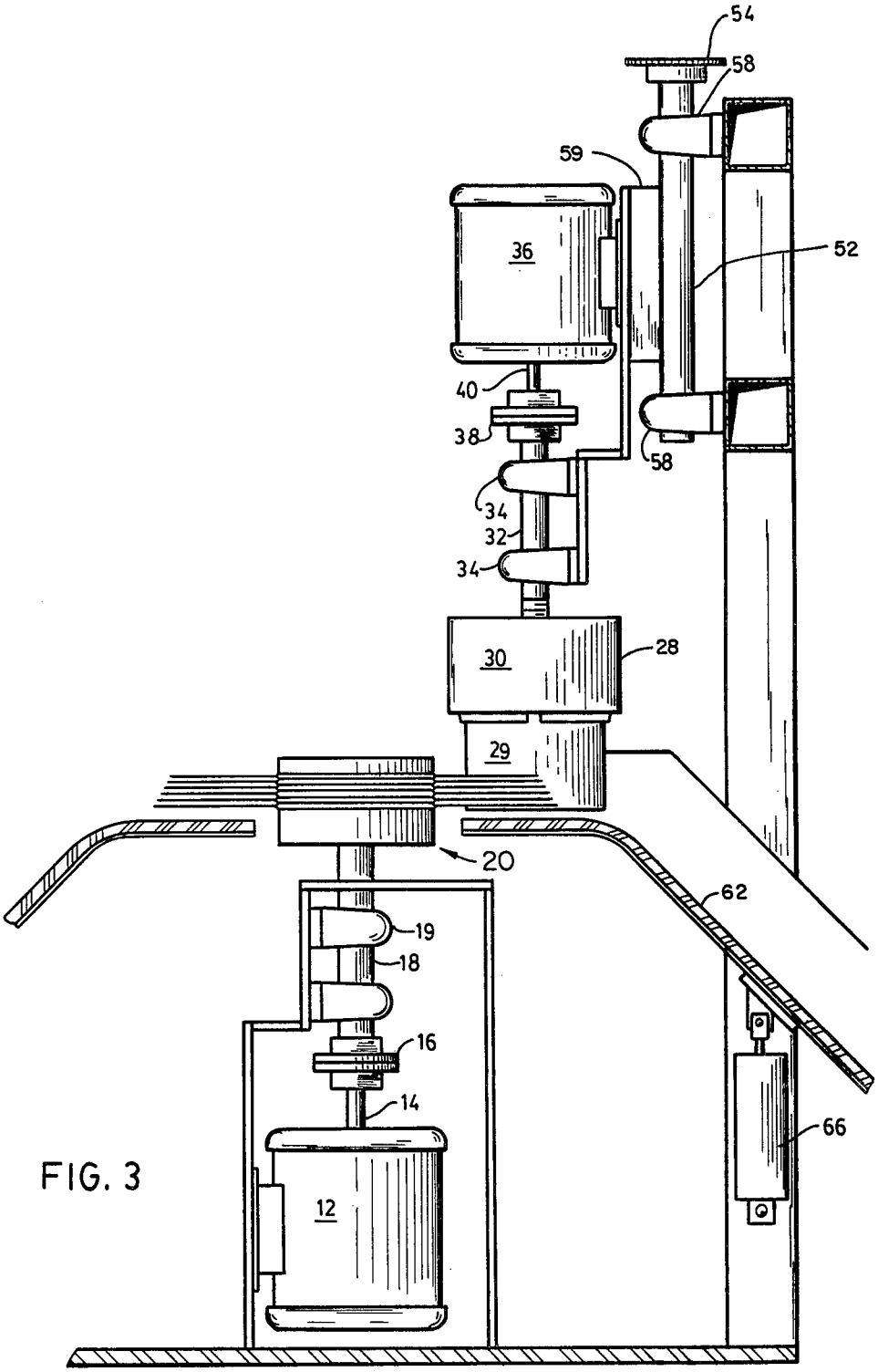
FIG. 3 is a side elevational view taken generally along line 3—3 of FIG. 2.

As shown in FIG. 3 boule holders 28 may be driven by motors 36 through drive shafts 40, couplings 38 and boule support shafts 32, journalled in supports 34. Boules 29 may be held in chucks 30 in a conventional fashion within the holders 28. Operation of motors 36 produces rotation of the boules 29 with direction of rotation of the boules corresponding to the direction of rotation of the motors.

There are several advantages in rotation of the boules 29 during the slicing of wafers therefrom. With the boule stationary during cutting, the blade must be large enough to cut through the entire diameter of the boule. However, with rotation of the boule, the blade need only be wide enough to cut through the radius of the boule. In addition, as the blade reaches the end of a cut with the boule stationary, the wafer support is cantilevered, i.e., being supported only by connection of its uncut portion with the remainder of the boule. There is a tendency for a wafer which is so supported to sustain a fracture at its point of connection.

A further advantage of rotating the boule is that the cutting debris made up of chips, particles and abrasives is more readily removed from the vicinity of the cut surface. If not removed, the debris tends to damage the surface of the wafer and cause excessive wear of the blade. In addition, such improved debris removal promotes more effective coolant flow during the slicing operation.

The boules 29 may be moved toward or into the blades 22 as slicing progresses by a fluid actuated cylinder 44 to cause movement of a rod 46 connected to a rotatable arm 50. The arm 50 may be fixedly connected to a shaft 52 having a gear 54 connected thereto.

Figure 2:
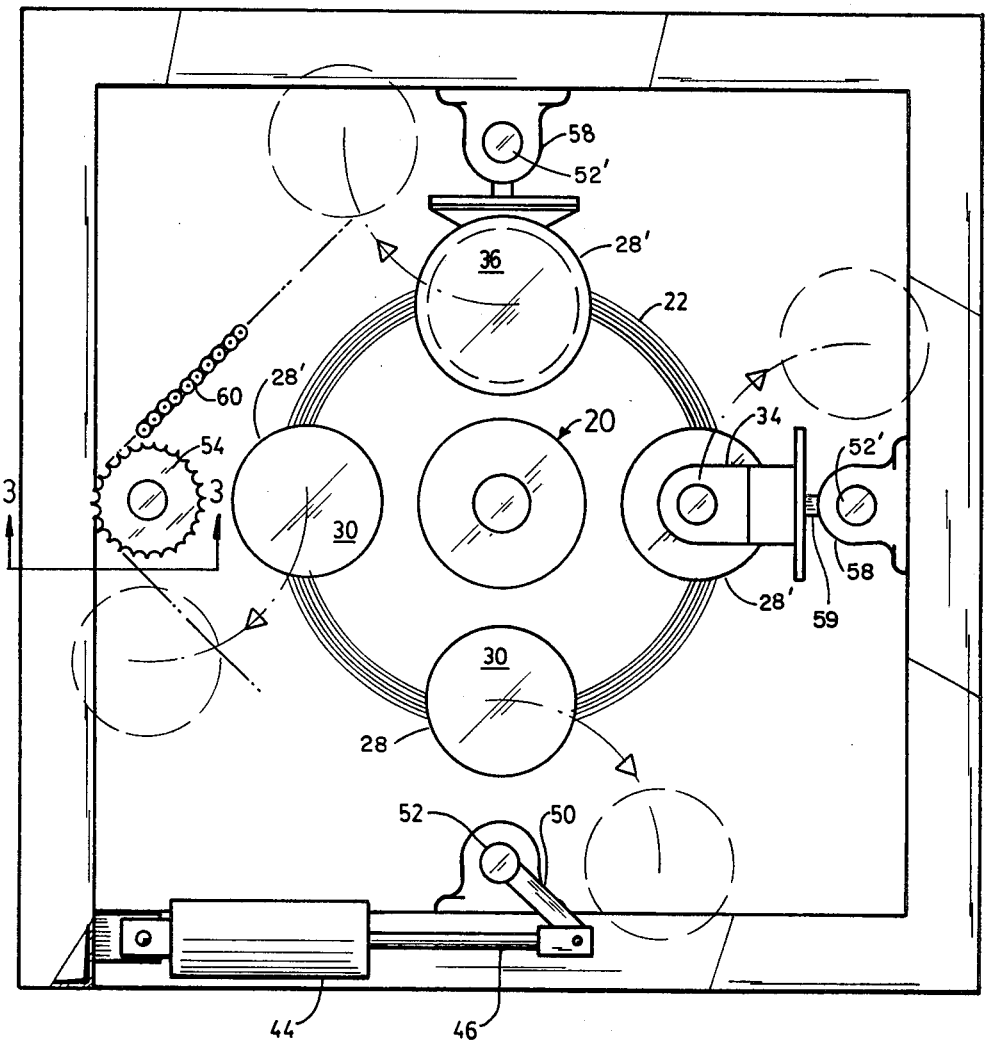
FIG. 2 is an enlarged top view of the embodiment shown in FIG. 1.

Each of the boule holders 28 (four being shown in FIG. 2) may be moved in a synchronous manner by means of a chain 60 that interconnects gears 54 that are respectively connected to a rotatable shaft 52 or 52'. For ease of illustration, the shaft 52 in FIG. 2 is driven directly from the arm 50 and piston rod 46. The other shafts designated 52' are driven through a driving gear 54 (not shown) connected directly to its driving shaft 52 and then through chain 60 interconnecting the other gears 54 connected to driven shafts 52'. Each of the shafts 52 and 52' may be positioned for rotatable movement within supports 58.

The axes of the motors 36, shafts 40 and 32, and holders 28 are offset from the axes of the shafts 52 and 52' by a radially extending brace 59. With rotation of the shafts 52 and 52', the braces 59 undergo radial movement to produce a corresponding movement of the supports 28 and 28' indicated by the arrows in FIG. 2. This in turn, causes movement of the supports 28 and 28' and the boules 29 supported thereby either toward or away from the blades 22.

It is preferred to simultaneously slice a multiple of boules, not only because of the increased production which can be achieved thereby, but also because it is then possible to arrange pairs of boule holders in opposed counterbalancing relationship. Through pairing, a source of dynamic or vibrational loading of the cutter blades along a direction normal to the blade rotation may be counteracted by or eliminated by producing opposing thrust and torque on both sides of each blade.

Figure 5A:
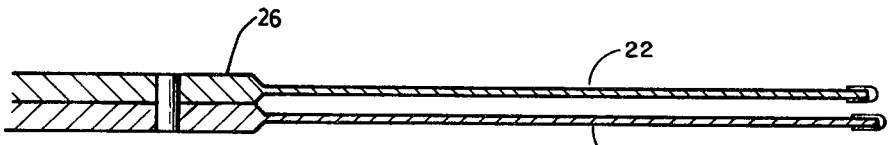
FIGS. 5A and 5B are fragmentary cross-sectional views of alternative types of cutting blades that may be used when the cutting surface is on the outer diameters of the blades.
Figure 5B:
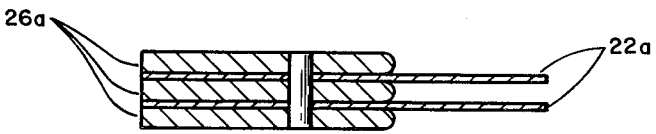

Blades 22 of approximately 6 mils in thickness and of circular configuration have been found suitable. With multiple slicing of each boule, adjacent blades may be spaced the thickness of a sliced wafer plus an allowance for waste which is governed by the thickness of the blade. Such spacing can be provided by using blades 22 having thickened center cross sections 26 as shown in FIG. 5A. In an alternative arrangement shown in FIG. 5B, the blades **22*a* have uniform thickness, but the spacing between blades is provided by washers or spacers 26*a*** of a desired thickness.

Figure 7:
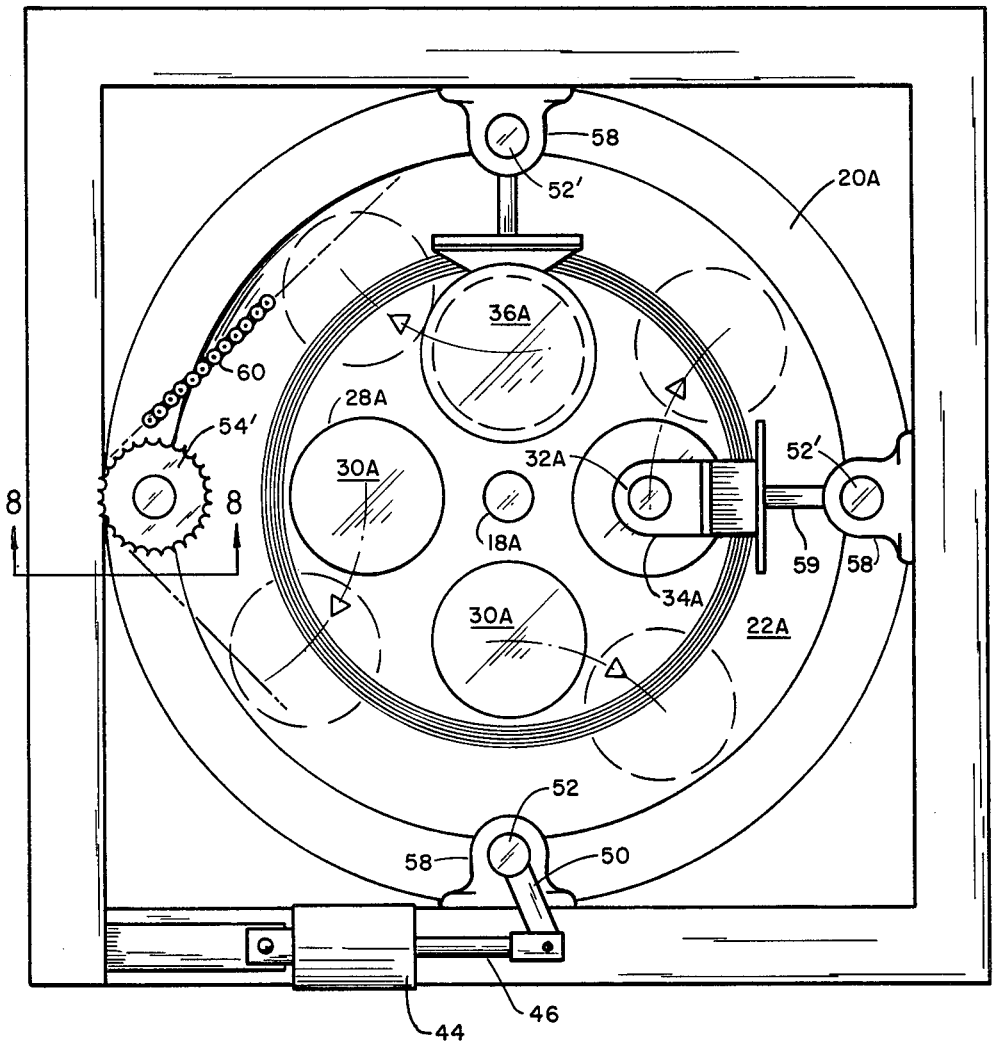
FIG. 7 is an enlarged top view of the embodiment shown in FIG. 6.
Figure 8:
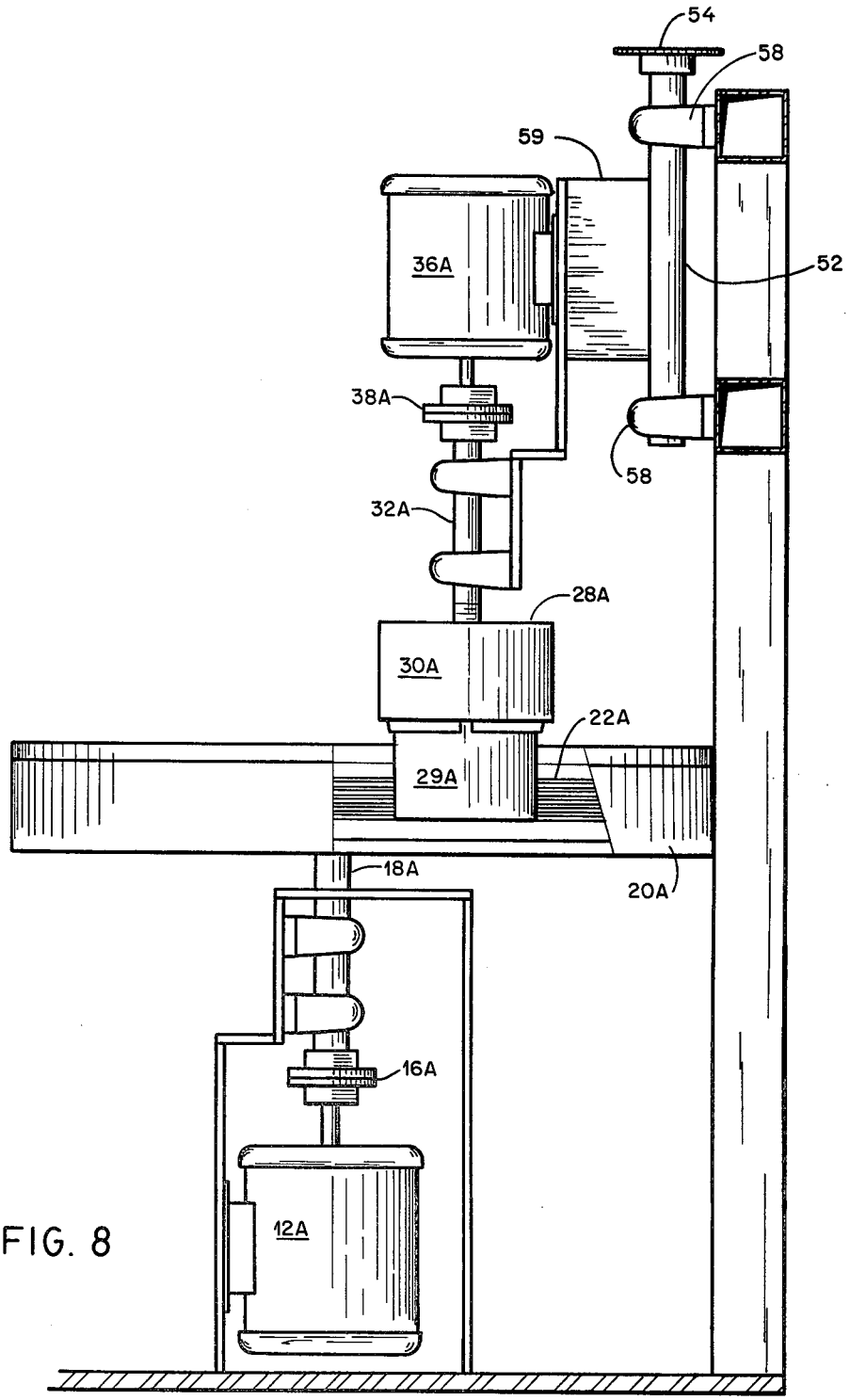
FIG. 8 is a side elevational view taken generally along line 8—8 of FIG. 7.

In the embodiment shown in FIGS. 6 through 10, the boules 29A are shifted outwardly toward the blade stack of the blades 22A, as indicated in FIG. 7, for engagement with the internal diameter cutting edges. This may be provided as in the embodiment of FIGS. 1–5 by actuation of cylinder 44 in the appropriate direction. (See FIG. 7.)

Figure 9:
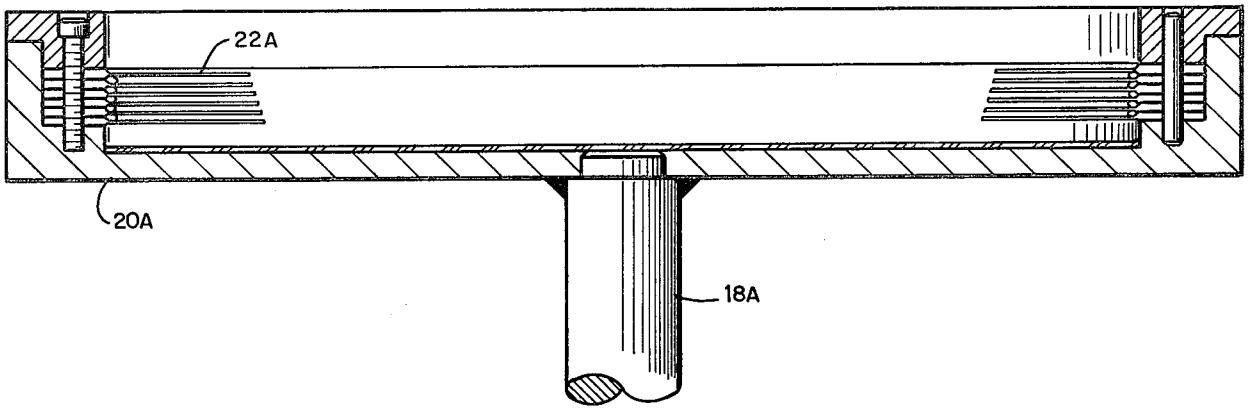
FIG. 9 is a cross-sectional view of a retainer cup which may be used in supporting the blades in the embodiments of FIGS. 6–8.

The main difference in the embodiment of FIGS. 6–10 is in the drive means for the blade stack 22A, which is dictated by the ring-shaped configuration of the blades. The blades 22A may be supported in a tub-like blade holder 20A in stacked, spaced relationship. As in the embodiment of FIGS. 1–5B, the blade may be of different diameter as indicated in FIG. 9. The holder 20A is supported on shaft 18A which is coupled at 16A to the shaft of a drive motor 12A. The boule holders 30A may be rotated by motors 36A through couplings 38A and support shafts 32A.

Figure 10:
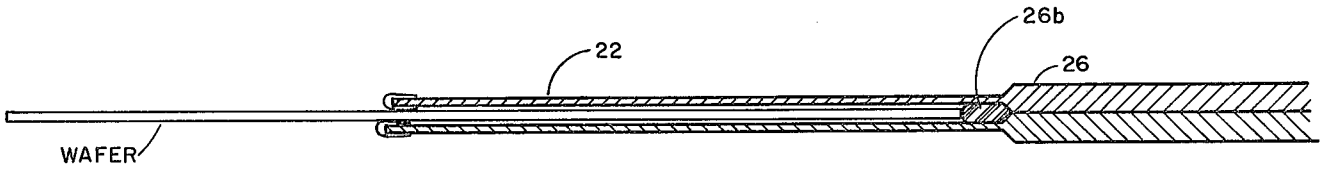
FIG. 10 is an enlarged fragmentary cross-sectional view of adjacent blades in a stack of cutting blades as shown in FIG. 9, in which a parted wafer is buffered and retained between the adjacent blades.

The lowermost wafers when parted from the boules 29A drop into the holder 20A which may serve as a wafer catcher. Other wafers, as they are subsequently severed, may be propelled outwardly into the space between the adjacent blades 22A. A washer-like resilient cushion 26*b* made of a material such as rubber or the like, as shown in FIGS. 9 and 10, may prevent damage to the wafers as they are parted from the boule. The wafers may lodge between the adjacent blades 22A, as indicated in FIG. 10, and be removed after cutting or slicing is completed.

Amon the unique features of the invention is the manner for parting of wafers from the boule as it is simultaneously sliced by a plurality of stacked blades. If all of the wafers were parted simultaneously from the boule, problems could arise near the end of slicing since all of the wafers would fall at essentially the same time. This can be avoided by allowing the parting of the wafers serially, i.e., in sequence, such that each wafer is severed at a slightly later time than the wafer below it.

Figure 4:
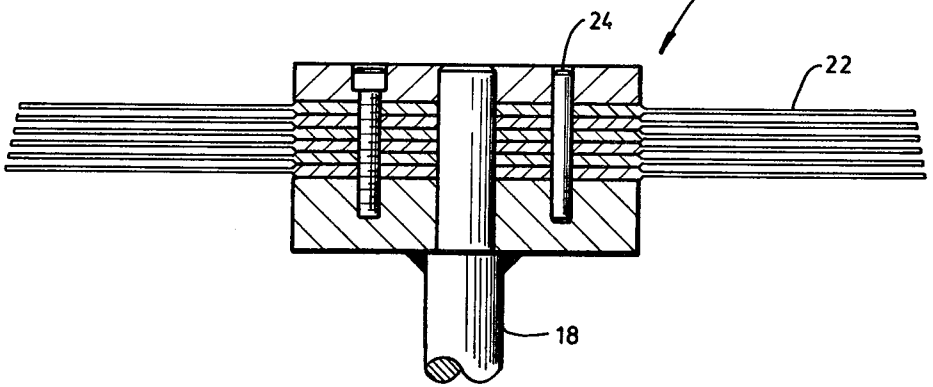
FIG. 4 is a cross-sectional view illustrating a blade holder for the embodiment of FIG. 1.
Figure 6:
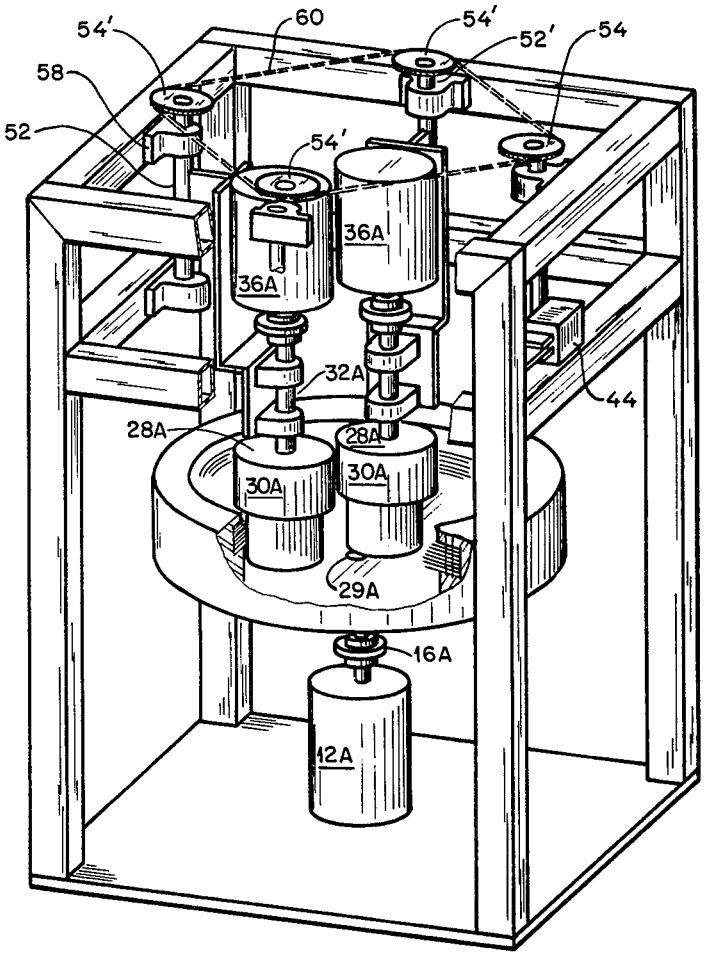
FIG. 6 is a fragmentary, perspective view of a second embodiment of the invention for use where the cutting surface is on the inner diameter of the blade.

This can be accomplished by using blades of different diameter such that the cutoff of each wafer takes place in order proceeding from the bottom of the boule upwardly. Referring to FIG. 4, it can be seen that the diameter of the lowermost blade 22 of the stack is larger than that of the blade immediately above it, and that the diameter of each blade in the stack is smaller than the diameter of the blade below it. This sizing of the stacked blades assures that the lowermost wafer is completely parted from the boule before the wafer above it is severed.

The arrangement for handling the parted wafers in the embodiment of FIGS. 1–5B may include an apron enclosure 62 which is covered with a resilient cushioning material such as rubber, so that parted wafers will not be damaged as they fall in sequence from the boules. As shown in FIG. 3, the top surface of the apron 62 may extend under the ganged blades to act as a receiving platform. The wafers may slide along this surface to the sloping sides of the apron 62 which guides the wafers to a receptacle or preferably to a conveyor belt (not shown) for removal to a desired location.

What is claimed is:

1. A method of simultaneously slicing silicon boules into wafers, comprising: providing a stack of mutually spaced, coaxially aligned, juxtaposed circular blades, each blade having a cutting diameter slightly greater than the cutting diameter of the blade arranged immediately thereabove; supporting diametrically opposed pairs of elongated boules of silicon for rotation about axes parallel to the axis of the circular blades, and moving each pair of boules parallel to their axes into and away from the stack of blades while rotating said blades and said boules to slice wafers from the boules, whereby the stresses imposed on the blades incident to slicing the wafers are balanced.

2. The method of claim 1 wherein said blades are positioned substantially horizontally and the cutting edges of said blades are positioned on their outer diameters.

3. The method of claim 1 wherein said blades are positioned substantially horizontally and the cutting edges of said blades are positioned on their inner diameters.

4. The method of claim 2 wherein the slicing of wafers from said boules is carried out seriatim with the lowermost wafer being sliced first.

5. The method of claim 3 wherein the slicing of wafers from said boules is carried out seriatim with the lowermost wafer being sliced first.

6. In an apparatus for simultaneously slicing a multiplicity of boules into wafers, the improvement comprising:

A. a stack of mutually spaced, coaxially aligned, substantially horizontal circular saw blades arranged in juxtaposed coaxial alignment, each blade having a cutting diameter slightly greater than the cutting diameter of the blade disposed immediately thereabove;

B. means for rotating said blades;

C. means for supporting a plurality of diametrically opposed pairs of elongated boules of silicon and for simultaneously and synchronously moving each pair of boules into and away from said blades as said blades are rotated, such that balanced stresses are imposed on the blades; and D. means for rotating the boules about their longitudinal axes as the boules contact said blades for slicing off wafers therefrom.

7. The apparatus of claim 6 wherein the cutting edges of said blades are positioned on their outer diameters.

8. The apparatus of claim 6 wherein the cutting edges of said blades are positioned on their inner diameters.

* * * * *